US009475290B2

(12) United States Patent
Fukuda

(10) Patent No.: US 9,475,290 B2
(45) Date of Patent: Oct. 25, 2016

(54) LIQUID EJECTING APPARATUS

(71) Applicant: SEIKO EPSON CORPORATION, Tokyo (JP)

(72) Inventor: Shunya Fukuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/513,097

(22) Filed: Oct. 13, 2014

(65) Prior Publication Data

US 2015/0029266 A1 Jan. 29, 2015

Related U.S. Application Data

(63) Continuation of application No. 13/673,237, filed on Nov. 9, 2012, now Pat. No. 8,888,232.

(30) Foreign Application Priority Data

Nov. 14, 2011 (JP) ..... 2011-248178

(51) Int. Cl.
*B41J 2/04* (2006.01)
*B41J 2/14* (2006.01)
*B41J 2/135* (2006.01)

(52) U.S. Cl.
CPC ..... *B41J 2/1433* (2013.01); *B41J 2/135* (2013.01)

(58) Field of Classification Search
CPC ..... B41J 2/16508; B41J 2/16505; B41J 2/16511; B41J 2002/16514; B41J 2002/16502; B41J 2/1631; B41J 2/1623; B41J 2/1433
USPC ..... 347/29, 47
See application file for complete search history.

(56) References Cited

U.S. PATENT DOCUMENTS

| | | | | |
|---|---|---|---|---|
| 5,943,079 | A | 8/1999 | Yoshida | |
| 6,672,704 | B2 | 1/2004 | Katakura et al. | |
| 6,679,595 | B2 * | 1/2004 | Yamada | B41J 2/14209 347/20 |
| 6,796,019 | B2 | 9/2004 | Komplin et al. | |
| 7,571,525 | B2 | 8/2009 | Matsuzawa et al. | |
| 7,594,714 | B2 * | 9/2009 | Katayama | 347/68 |
| 7,712,864 | B2 | 5/2010 | Shindo et al. | |
| 7,878,620 | B2 * | 2/2011 | Hasegawa | 347/29 |
| 2003/0098900 | A1 | 5/2003 | Tokunaga | |
| 2004/0001124 | A1 | 1/2004 | Ito | |

(Continued)

FOREIGN PATENT DOCUMENTS

| | | |
|---|---|---|
| JP | 9-141857 | 6/1997 |
| JP | 2006-095725 | 4/2006 |

(Continued)

*Primary Examiner* — Matthew Luu
*Assistant Examiner* — Patrick King
(74) *Attorney, Agent, or Firm* — Workman Nydegger

(57) ABSTRACT

A liquid ejecting apparatus includes a pressure chamber that communicates with a nozzle which has an opening at a nozzle formation surface; a communication plate where a common liquid chamber which supplies a liquid to the pressure chamber is formed; a liquid ejecting head having a flexible film which seals the opening surface at the nozzle formation surface side of the common liquid chamber in the communication plate; and a sealing member which has a cavity-shaped sealing hollow section and can be sealed by the nozzle formation surface being confronted in the sealing hollow section. The sealing member is configured so as to be sealable by at least a portion of the flexible film being confronted in the sealing hollow section in a sealed state of the nozzle formation surface.

3 Claims, 4 Drawing Sheets

(56) References Cited

U.S. PATENT DOCUMENTS

| | | | | |
|---|---|---|---|---|
| 2004/0095415 | A1* | 5/2004 | Aldrich et al. | 347/29 |
| 2006/0066690 | A1 | 3/2006 | Katayama | |
| 2006/0158480 | A1 | 7/2006 | Ito | |
| 2006/0250456 | A1 | 11/2006 | Matsuzawa et al. | |
| 2007/0247492 | A1 | 10/2007 | Mori | |
| 2008/0117256 | A1 | 5/2008 | Linliu | |
| 2008/0284814 | A1 | 11/2008 | Chikamoto et al. | |
| 2009/0027444 | A1 | 1/2009 | Yoshida et al. | |
| 2009/0058935 | A1* | 3/2009 | Owaki | 347/47 |
| 2009/0109264 | A1* | 4/2009 | Kubo | 347/71 |
| 2009/0185005 | A1* | 7/2009 | Sakai et al. | 347/47 |
| 2009/0201334 | A1* | 8/2009 | Hasegawa | 347/29 |
| 2009/0267999 | A1 | 10/2009 | Matsuzawa et al. | |
| 2011/0221824 | A1 | 9/2011 | Sakata et al. | |
| 2012/0007909 | A1* | 1/2012 | Zhang | B41J 2/055 347/17 |
| 2012/0224001 | A1* | 9/2012 | Park | 347/30 |
| 2013/0244352 | A1* | 9/2013 | Takahashi | H01L 21/30604 438/21 |

FOREIGN PATENT DOCUMENTS

| | | |
|---|---|---|
| JP | 2006-198812 | 8/2006 |
| JP | 2006-306022 | 11/2006 |
| JP | 2010-162862 | 7/2010 |
| JP | 2011-093254 | 5/2011 |

* cited by examiner

LIQUID EJECTING APPARATUS

CROSS-REFERENCE TO RELATED APPLICATIONS

This application is a continuation application of U.S. patent application Ser. No. 13/673,237, filed Nov. 9, 2012, which patent application is incorporated herein by reference in its entirety. U.S. patent application Ser. No. 13/673,237 claims the benefit of Japanese Patent Application No. 2011-248178 filed Nov. 14, 2011, the contents of which are hereby incorporated by reference in its entirety.

BACKGROUND

1. Technical Field

The present invention relates to a liquid ejecting apparatus such as an ink jet type printer that includes a liquid ejecting head which ejects a liquid in a pressure chamber from a nozzle by applying pressure fluctuations to the pressure chamber communicating with the nozzle.

2. Related Art

A liquid ejecting apparatus includes a liquid ejecting head and ejects various liquids from the ejecting head. As the liquid ejecting apparatus, for example, there is an image recorder such as an ink jet type printer or an ink jet plotter. However, in recent years, the liquid ejecting apparatus has been adopted to various manufacturing apparatuses as well by making use of an advantage which enables a tiny amount of the liquid to be exactly landed on a predetermined position. For example, the liquid ejecting apparatus has been adopted to a display manufacturing apparatus which manufactures a color filter such as a liquid crystal display, an electrode formation apparatus which forms an electrode such as an organic EL (Electro Luminescence) display or FED (Face Emitting Display), and a chip manufacturing apparatus which manufactures a biochip (biochemical device). Then, a recording head for the image recorder ejects a liquid ink and a coloring material ejecting head for the display manufacturing apparatus ejects each solution of coloring materials of R (Red), G (Green) and B (Blue). In addition, an electrode ejecting head for the electrode formation apparatus ejects a liquid electrode material and a bio-organic material ejecting head for the chip manufacturing apparatus ejects a solution of a bio-organic material.

Such a liquid ejecting head includes a piezoelectric device which changes the volume in a pressure chamber where a nozzle has an opening, and a common liquid chamber (also referred to as a reservoir or a manifold) which supplies the liquid to the pressure chamber. As a known liquid ejecting head, there is a liquid ejecting head configured such that the upper surface of the common liquid chamber is sealed by an elastic film (flexible film) having flexibility and thereby pressure fluctuations of a liquid in the common liquid chamber are absorbed (for example, refer to JP-A-2006-306022). Therefore, a space is formed at the opposite side to the common liquid chamber so as not to hinder the elastic film from elastic deformation and the space is open to the atmosphere.

However, in such a configuration, there has been a problem that moisture in a common liquid chamber evaporates via the elastic film and thus the liquid becomes thickened. In order to solve the problem, it has been acknowledged that a tube (bent path) which connects the atmosphere and the opposite side space to the common liquid chamber of the elastic film is made to be slender and serpentine so as to prevent diffusion of gasses. However, it has been an insufficient manner so far. In particular, the liquid becomes remarkably thickened due to moisture evaporation in a case where the liquid is not ejected over a long period of time.

SUMMARY

An advantage of the invention is to provide a liquid ejecting apparatus which can allow compliance in the common liquid chamber and can prevent the thickening of the liquid in a liquid ejecting head.

An aspect of the invention is to provide a liquid ejecting apparatus which includes a pressure chamber that communicates with a nozzle which has an opening at a nozzle formation surface; a substrate where a common liquid chamber which supplies a liquid to the pressure chamber is formed; a liquid ejecting head having a flexible film which seals the opening surface at the nozzle formation surface side of the common liquid chamber in the substrate; and a sealing member which has a cavity-shaped sealing hollow section and can be sealed by the nozzle formation surface being confronted in the sealing hollow section. The sealing member is configured so as to be sealable by at least a portion of the flexible film being confronted in the sealing hollow section in a sealed state of the nozzle formation surface.

According to the aspect of the invention, it is possible to allow compliance at the lower side of the common liquid chamber since the opening surface of the nozzle formation surface side of the common liquid chamber is sealed by the flexible film. In addition, since the flexible film can be also sealed by the sealing member which seals the nozzle formation surface, it is possible to prevent moisture evaporation from the sealed portion and it is possible to suppress the thickening of the liquid in the liquid ejecting head.

In addition, in the above-described configuration, it is preferable that the entire surface of a portion corresponding to the common liquid chamber within an opposite side surface to the common liquid chamber of the flexible film be able to be sealed.

According to the configuration, it is possible to prevent moisture evaporation from the common liquid chamber and it is possible to more reliably suppress the thickening of the liquid in the liquid ejecting head.

Furthermore, in the above-described configuration, it is preferable that the liquid ejecting head protect the opposite side surface to the common liquid chamber of the flexible film in a covered state, and includes a protection substrate where a space which does not hinder flexible deformation of the flexible film is provided in at least one portion within a section corresponding to the common liquid chamber of the flexible film; and the sealing member is sealable such that the flexible film including the protection substrate is confronted in the sealing hollow section from both sides at the opposite side to the flexible film of the protection substrate.

In addition, it is preferable to adopt a configuration where the protection substrate has a wall section which encloses the periphery of the flexible film, and a bottom section which is separated from the opposite side surface to the common liquid chamber of the flexible film.

Furthermore, it is preferable to adopt a configuration where the flexible film is layered on the protection substrate, and has an opening in at least one portion within a section corresponding to the common liquid chamber.

According to those configurations, for example, it is possible to prevent damage to the flexible film due to touching of a recording medium (landing target) on the flexible film or the like. In addition, it is possible to prevent moisture evaporation from the flexible film using the protection substrate and thereby it is possible to more reliably suppress the thickening of the liquid in the common liquid chamber.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the accompanying drawings. Incidentally, the embodiments to be described below have various limitations as a preferred specific example. However, the scope of the present invention is not limited to the embodiments, unless otherwise specifically described to limit the present invention in the following description. In addition, as the liquid ejecting apparatus of the present invention, the following description is made by exemplifying an ink jet type printer 1 (one kind of liquid ejecting apparatus of the invention).

Figure 1:
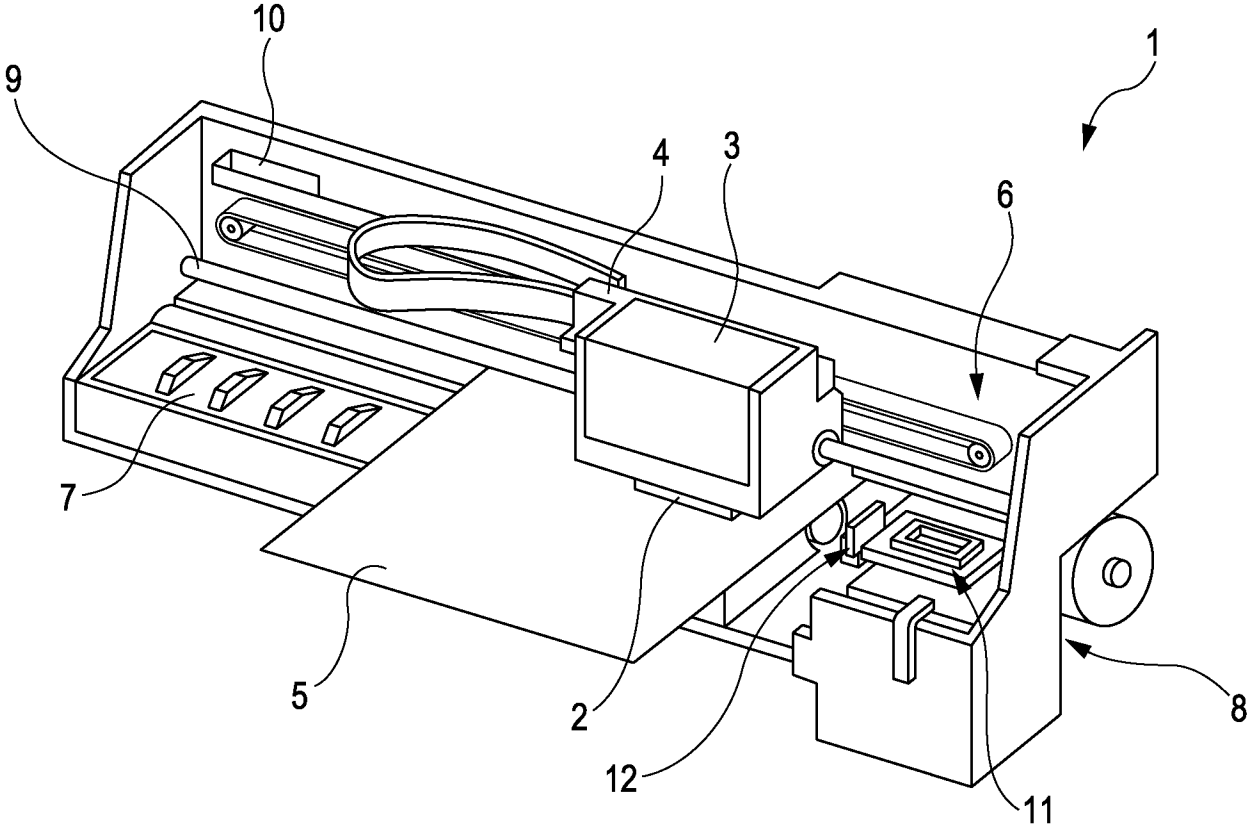
FIG. 1 is a perspective view illustrating a configuration of a printer.

FIG. 1 is a perspective view illustrating a configuration of the printer 1. The printer 1, an ink jet type recording head 2 (hereinafter referred to as a recording head) which is a kind of liquid ejecting head being attached thereto, includes a carriage 4 to which an ink cartridge 3, which is a kind of liquid storage member, is detachably attached. A carriage moving mechanism 6 which allows the carriage 4 to reciprocate in the paper width direction of a recording paper 5 (one kind of recording medium and landing target), that is, in the horizontal scanning direction, is provided at the rear section of the carriage 4. In addition, a platen 7 is provided, leaving space, below the recording head 2 during the recording operation. On the platen 7, a transportation mechanism 8 provided behind the printer 1 transports the recording paper 5 in a vertical scanning direction perpendicular to the horizontal direction.

The carriage 4 is pivotally attached to a guide rod 9 installed in the horizontal direction, and moves along the guide rod 9 in the horizontal direction using the operation of the carriage moving mechanism 6. The position of the carriage 4 in the horizontal direction is detected by a linear encoder 10 which is a kind of positional information detector, and the detected signal, that is, an encoder pulse (a kind of positional information) is transmitted to a control unit of the printer 1. A home position which becomes a reference point for the scanning of the carriage 4 is set a further outside end region than the recording region within the movement range of the carriage 4. The printer 1 performs a so-called interactive recording which records a character or an image on the recording paper 5 in the two-way direction during the travelling movement where the carriage 4 moves from the home position toward the opposite side end and during the returning movement where the carriage 4 returns from the opposite side end to the home position side.

Figure 2:
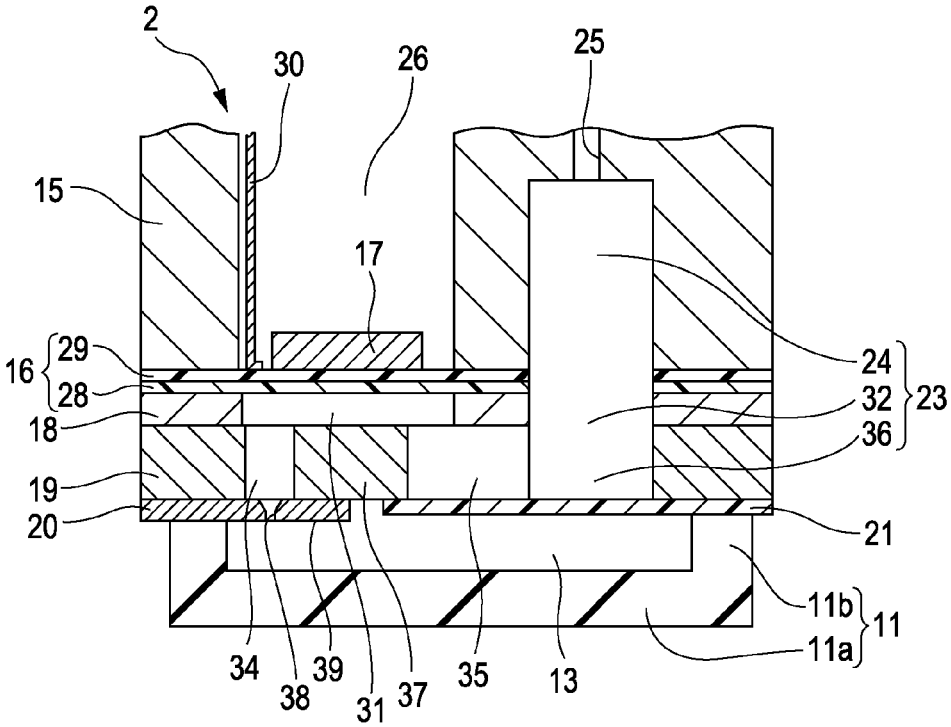
FIG. 2 is a cross-sectional view of a recording head in a sealed state using a capping member in a first embodiment.

In addition, a capping member 11 (sealing member in the present invention) which seals a nozzle formation surface 39 (nozzle plate 20: refer to FIG. 2: to be described later) and a wiper member 12 for wiping out the nozzle formation surface 39 are arranged at the home position. As illustrated in FIG. 2, the capping member 11 is a tray-shaped member that includes an open upper surface which has a rectangular sealing bottom section 11*a* and a sealing sidewall section 11*b* erected from the fringe of the sealing bottom section 11*a*, and is formed from an elastic member such as rubber. The capping member 11 in the present embodiment is configured such that the entire surface of a portion corresponding to a reservoir 23, which is the lower surface (which is the opposite side surface to the reservoir 23, to be described later) of a flexible film 21 (to be described later) and the nozzle formation surface 39, is sealable in a state of being confronted in a sealing hollow section 13 enclosed by the sealing bottom section 11*a* and the sealing sidewall section 11*b*, by bringing the end edge of the sealing sidewall section 11*b* into close contact with the recording head 2 side. In other words, the capping member 11 has a cavity-shaped sealing hollow section 13 and is configured to be sealable such that the entire surface of a flexible film 21 which is in contact with the nozzle formation surface 39 and the reservoir 23 in the sealing hollow section 13 is confronted. Furthermore, the capping member 11 seals the lower surfaces of the nozzle formation surface 39 and the flexible film 21 in a case without performing the recording operation.

In addition, a pump (not illustrated) is connected to the capping member 11 to reduce a pressure inside thereof. Accordingly, it is possible to absorb air bubbles or thickened ink in the recording head 2 from a nozzle 38 by operating the pump after the nozzle formation surface 39 is sealed using the capping member 11. Furthermore, the inside of the capping member 11 includes a member for maintaining a high humidity state in the sealing hollow section 13, for example, a sponge or the like (not illustrated) containing ink. Therefore, in a state where the capping member 11 seals the lower surface of the nozzle formation surface 39 and the flexible film 21, a high humidity state is maintained in the sealing hollow section 13 and moisture evaporation from the nozzle 38 and the flexible film 21 is prevented.

FIG. 2 is a cross-sectional view of the recording head 2 in a state of being sealed by the capping member 11. The recording head 2 according to the present embodiment includes a head case 15, a vibrating plate 16, a piezoelectric device 17, a flow path substrate 18, a communication plate 19, a nozzle plate 20 and the flexible film 21. Furthermore, the flow path substrate 18 and the communication plate 19 correspond to a substrate according to the present invention.

The head case 15 is a hollow box body-shaped member where a guiding hollow section 24 which becomes a portion of a reservoir 23 (corresponding to a common liquid chamber) and a case flow path 25 which supplies the ink to the guiding hollow section 24 from the ink cartridge 3 are formed inside. The guiding hollow section 24 is a long hollow section along a nozzle line direction (to be described later), and communicates with a communication hollow section 32 (to be described later) by the lower side (nozzle plate 20 side) being open. The case flow path 25 has the lower end side communicated with the upper portion (ceiling section) of the guiding hollow section 24, and has the upper end side communicated with an ink guiding needle (not illustrated) connected to the ink cartridge 3. In addition, an insertion space 26 penetrated in the height direction is formed at a section corresponding to the piezoelectric device 17 of the head case 15. A flexible cable 30 (to be described later) is inserted into the insertion space 26.

The vibrating plate 16 is an elastic substrate where an elastic film 28 and an insulator film 29 are layered, and are adhered to the lower surface of the head case 15. A section corresponding to the guiding hollow section 24 of the vibrating plate 16 is vertically penetrated, and allows the guiding hollow section 24 to communicate with the communication hollow section 32. The piezoelectric device 17 (a kind of pressure generator) where a lower electrode film, a piezoelectric body layer and an upper electrode film are sequentially layered is formed at a section opposing a pressure chamber 31, which is the section on the insulator film 29. Electrode wiring sections (not illustrated) are respectively extended on the insulator film from each electrode (upper electrode film) of the piezoelectric device 17. One end terminal of the flexible cable 30 is connected to a section corresponding to an electrode terminal of each of the electrode wiring sections. The flexible cable 30, for example, is configured by forming a conductor pattern using a copper foil or the like on the surface of a base film such as polyimide and by covering the conductor pattern using a resist. In addition, a drive IC (not illustrated) which drives the piezoelectric device 17 is mounted on the surface of the flexible cable 30. Then, the piezoelectric device 17 is bent by applying a drive signal (drive voltage) to between the upper electrode film and the lower electrode film through the drive IC.

The flow path substrate 18 is a substrate which is adhered to the lower surface of the vibrating plate 16 (elastic film 28) and manufactured from a silicon single crystal substrate, a SUS or the like. The flow path substrate 18 has a plurality of pressure chambers 31 corresponding to each nozzle 38 of the nozzle plate 20. The pressure chamber 31 is a long hollow section in a direction perpendicular to the nozzle line direction and one side end thereof in the longitudinal direction is made to communicate with the nozzle 38 via a nozzle communication path 34 of the communication plate 19 (to be described later). In addition, the other side end of the pressure chamber 31 in the longitudinal direction is made to communicate with the reservoir 23 via a supply side communication path 35 of the communication plate 19 (to be described later). In addition, the communication hollow section 32 is formed, in a state of being penetrated in the plate thickness direction, at a section corresponding to the guiding hollow section 24 within the flow path substrate 18. The communication hollow section 32 has the upper portion communicated with the guiding hollow section 24 and has the lower portion communicated with a reservoir portion 36 of the communication plate 19 (to be described).

The communication plate 19 is a substrate which is adhered to the lower surface of the flow path substrate 18 and manufactured from a silicon single crystal substrate, a SUS or the like. The nozzle communication path 34, the supply side communication path 35 and the reservoir portion 36 are formed at the communication plate 19 in a state of being penetrated in the plate thickness direction. The nozzle communication path 34 is plurally formed corresponding to each of the pressure chambers 31, has the upper portion communicated with the pressure chamber 31 and has the lower portion communicated with the nozzle 38. The supply side communication path 35 is plurally formed corresponding each of the pressure chambers 31 at the reservoir portion 36 side, by pinching the nozzle communication path 34 and a partitioning section 37. The supply side communication path 35 is a flow path which allows each of the pressure chambers 31 to communicate with the reservoir 23 (reservoir portion 36). The reservoir portion 36 is a hollow portion configuring a portion of the reservoir 23 and has the upper portion communicated with the communication hollow section 32. That is, the reservoir 23 which supplies common inks to each of the pressure chambers 31 and becomes long along the nozzle line direction is configured by a series of flow paths formed from the guiding hollow section 24, the communication hollow section 32 and the reservoir portion 36.

The nozzle plate 20 is a plate member which is adhered to the lower surface of the communication plate 19 and where a plurality of nozzles 38 is installed in line at a pitch corresponding to dot formation density. For example, a line of nozzles (a kind of nozzle group) is configured by arraying 360 nozzles 38 at the pitch corresponding to 360 dpi. The nozzle plate 20 of the present embodiment is manufactured from the silicon single crystal substrate and includes the nozzles 38 which are cylindrical in shape by performing dry etching. In addition, the nozzle plate 20 is set to be as small as possible within a range to reliably secure a liquid-tightness between the nozzle communication path 34 and the nozzle 38 (that is, so far as an adhering charge obtained by the nozzle communication path 34 and the nozzle 38 being communicated with each other in a liquid-tight state can be secured). Since the nozzle plate 20 is miniaturized as far as possible in this manner, it is possible to contribute to a decrease in cost. In the present embodiment, the opposite side end to the reservoir 23 is aligned with the outward shape of the recording head 2 and the end of the reservoir 23 side is extended up to the middle of the partitioning section 37 of the communication plate 19. Furthermore, the lower surface of the nozzle plate 20 corresponds to the nozzle formation surface 39 according to an aspect of the present invention.

The flexible film 21 is a film formed from a resin or the like capable of flexible deformation (elastic deformation), and is bonded at the lower surface of the communication plate 19 using an adhesive. In the flexible film 21 of the present embodiment, the end of the nozzle plate 20 side is extended up to the middle of the partitioning section 37, that is, up to a section which does not interfere with the nozzle plate 20. In contrast, the opposite side end to the nozzle plate 20 is aligned with the outer shape of the recording head 2. Accordingly, the supply side communication path 35 in the communication plate 19 and the opening surface at the lower side (nozzle formation surface 39 side) of the reservoir portion 36 are sealed by the flexible film 21. That is, the supply side communication path 35 and the bottom surface of the reservoir portion 36 are configured using the flexible film 21. In this manner, the supply side communication path 35 and the bottom surface of the reservoir 23 can be deformed and thereby functions as a compliance section.

Then, the ink from the ink cartridge 3 is supplied to the pressure chamber 31 via the case flow path 25, the reservoir 23 and the supply side communication path 35. If the piezoelectric device 17 is driven in this state, pressure fluctuations occur in the ink within the pressure chamber 31. The ink is ejected from the nozzle 38 using the pressure fluctuations. Here, pressure fluctuations occurring within the pressure chamber 31 are also transmitted to the reservoir 23 side. However, owing to the flexible deformation of the flexible film 21, it is possible to absorb the pressure fluctuations of the ink within the reservoir 23.

In addition, in a case where the recording operation is not performed, the nozzle formation surface 39 and the lower surface of the flexible film 21 are sealed within the sealing hollow section 13 of the capping member 11. In the present embodiment, within the lower surface of the recording head 2, the entire surface of a section corresponding to the nozzle communication path 34, the supply side communication path 35 and the reservoir 23 is configured to be sealable. Accordingly, a section which is in contact with the nozzle 38, the ink flow path (in the present embodiment, the supply side communication path 35 and the reservoir 23) of the flexible film 21 is isolated from the atmosphere. Therefore, moisture evaporation from the nozzle 38 and moisture evaporation permeating through the flexible film 21 from the ink flow path are suppressed. As a result, the thickening of the ink within the flow path is suppressed. In addition, since the bonded section (section overlapped with the partitioning section 37 of the flexible film 21) between the flexible film 21 of the nozzle plate 20 side and the communication plate 19 is also sealed, moisture evaporation is suppressed via the adhesive of the bonded section thereof. Furthermore, for example, it is possible to positively maintain a high humidity state within the sealing hollow section 13 by arranging a sponge or the like containing the ink within the sealing hollow section 13. In this case, moisture evaporation can be further suppressed.

Furthermore, the capping member 11 is formed from an elastic member such as rubber. Therefore, even in a case where the nozzle plate 20 and the flexible film 21 have a different thicknesses and little height difference, the upper end surface (contact surface) of the sealing sidewall section 11*b* is subject to elastic deformation in keeping with the thickness thereof (height difference). Accordingly, it is possible to seal the lower surface of the recording head 2. In addition, a step may be provided in advance on the upper end surface of the sealing sidewall section 11*b* of the capping member 11 in keeping with the thickness of the nozzle plate 20 and the flexible film 21.

In this manner, since the opening surface of the nozzle formation surface 39 side of the reservoir 23 is sealed using the flexible film 21, it is possible to allow compliance at the lower side of the reservoir 23. In addition, the flexible film 21 is also sealed by the capping member 11 which seals the nozzle formation surface 39. Accordingly, it is possible to prevent moisture evaporation from the sealed section and it is possible to suppress the thickening of the ink within the recording head 2. In the present embodiment, the entire surface of a section corresponding to the reservoir 23 within the opposite side surface to the reservoir 23 of the flexible film 21 is set to be sealable. Consequently, it is possible to prevent moisture evaporation from the reservoir 23 and it is possible to more reliably suppress the thickening of the liquid within the recording head 2.

Meanwhile, the present invention is not limited to the above-described embodiment and various modifications can be made based on some aspects of the invention.

For example, the capping member 11 according to the above-described embodiment seals the entire surface of the section corresponding to the supply side communication path 35 of the flexible film 21 and the reservoir 23, but at least a portion of the flexible film 21 may be sealed. Accordingly, at the least, it is possible to prevent moisture evaporation from the sealed portion and it is possible to suppress the thickening of the ink within the recording head.

Figure 3:
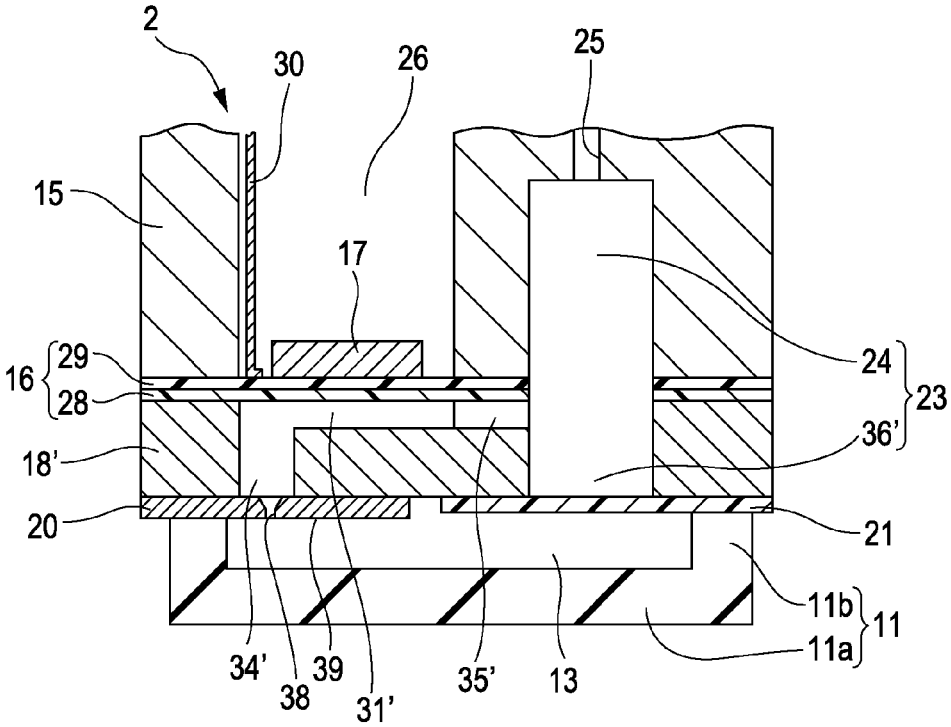
FIG. 3 is a cross-sectional view of a recording head in a sealed state using a capping member in a second embodiment.

In addition, if the recording head includes the pressure chamber that communicates with the nozzle which is open to the nozzle formation surface, the substrate where the reservoir (reservoir portion which is a part of the reservoir) that supplies the liquid to the pressure chamber is formed, and the flexible film that seals the opening surface of the nozzle formation surface side of the reservoir in the substrate, any kind of structure may be used. For example, a recording head 2 of a second embodiment illustrated in FIG. 3 does not include the communication plate.

More specifically, the recording head 2 of the second embodiment includes a head case 15, a vibrating plate 16, a piezoelectric device 17, a flow path substrate 18', a nozzle plate 20 and a flexible film 21. Furthermore, the head case 15, the vibrating plate 16, the piezoelectric device 17 and the nozzle plate 20 are the same as those of the recording head 2 in the first embodiment, and thus the description will be omitted. In addition, in the present embodiment, the flow path substrate 18' corresponds to the substrate in the present invention.

The flow path substrate 18' of the present embodiment is adhered to the lower surface of the vibrating plate 16 (elastic film 28) and includes a reservoir portion 36', a supply side communication path 35', a pressure chamber 31' and a nozzle communication path 34'. In detail, the reservoir portion 36' and the nozzle communication path 34' are formed by being penetrated in the plate thickness direction and the supply side communication path 35' and the pressure chamber 31' are formed, by half etching, from the upper surface (surface of the vibrating plate 16 side) of the flow path substrate 18' to the middle of the flow path substrate 18' in the thickness direction. The reservoir portion 36' is a hollow portion configuring a portion of a reservoir 23 similarly to the first embodiment, and the upper portion thereof communicates with a guiding hollow section 24. That is, in the present embodiment, a series of flow paths formed from the guiding hollow section 24 and the reservoir portion 36' configures the reservoir 23 which supplies the common ink to each pressure chamber 31' and becomes long along the nozzle line direction. The supply side communication path 35' is a narrow section having a narrow path width, which allows each pressure chamber 31' to communicate with the reservoir 23. The pressure chamber 31' is a hollow portion which is long along the direction perpendicular to the nozzle line, and communicates with the nozzle communication path 34' at the opposite side to the supply side communication path 35'. The nozzle communication path 34' has the bottom surface configured of the nozzle plate 20, and communicates with a nozzle 38 which is open to the nozzle plate 20.

The flexible film 21 is adhered to the lower surface of the flow path substrate 18' by an adhesive in a fluid-tight manner, and seals the lower side opening surface of the reservoir 23 (reservoir portion 36'). The flexible film 21 of the present embodiment is extended to a section which does not interfere with the nozzle plate 20, by leaving the end of the nozzle plate 20 side between the reservoir portion 36' and the nozzle communication path 34'. On the other hand, the opposite side end to the nozzle plate 20 is aligned with outer shape of the recording head 2 similarly to the first embodiment. Accordingly, the reservoir 23 has a bottom surface configured of the flexible film 21 and thereby compliance is allowed.

In this manner, since an opening surface of a nozzle formation surface 39 side of the reservoir 23 is sealed by the flexible film 21, it is possible to allow the compliance at the lower side of the reservoir 23. In addition, the flexible film 21 is also sealed by a capping member 11 which seals the nozzle formation surface 39. Accordingly, it is possible to prevent moisture evaporation from the sealed section and it is possible to suppress thickening of ink within the recording head 2. In the present embodiment, the entire surface of a section corresponding to the reservoir 23 within the opposite side surface to the reservoir 23 of the flexible film 21 is set to be sealable. Therefore, it is possible to prevent moisture evaporation from the reservoir 23 and it is possible to more reliably suppress the thickening of the liquid within the recording head 2. Furthermore, the other configuration of the printer 1 is similar to the above-described first embodiment and thus the description will be omitted.

In addition, in each of the above described embodiments, the lower surface of the flexible film 21 is exposed in a state of not being sealed by the capping member 11, but it is also possible to cover the lower surface of the flexible film 21 using a protection member. In detail, it is also possible that the opposite side surface to the reservoir 23 of the flexible film 21 is protected in a covered state, and the recording head 2 includes a protection substrate 41 provided with a space which does not hinder the flexible film 21 from flexible deformation in at least a portion within a section corresponding to the reservoir 23 of the flexible film 21.

Figure 4:
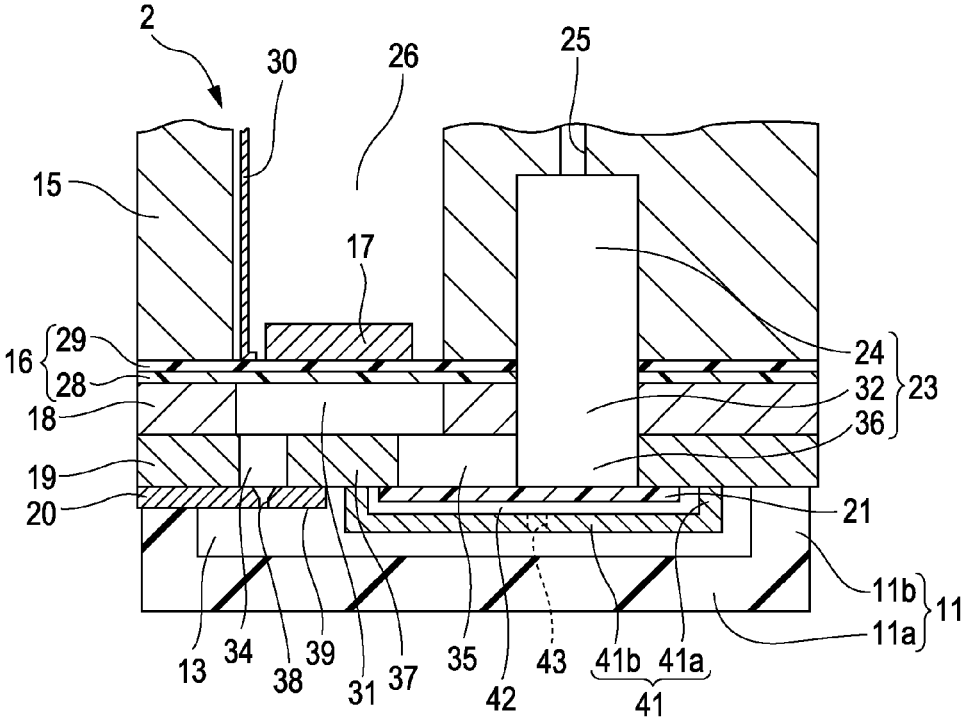
FIG. 4 is a cross-sectional view of a recording head in a sealed state using a capping member in a third embodiment.

For example, a recording head 2 of a third embodiment illustrated in FIG. 4 includes a protection substrate 41 where a wall section 41*a* which encloses the periphery of a flexible film 21, and a bottom section 41*b* which is isolated from the opposite side surface to a reservoir 23 of the flexible film 21 are provided. More specifically, the protection substrate 41 has a protection space 42 which becomes hollowed in a concave shape, and in a state where the entire flexible film 21 is confronted in the protection space 42, an opening edge (upper surface of the wall section 41*a*) of the protection space 42 is adhered to a communication plate 19. Furthermore, a vent 43 is open to the bottom section 41*b* of the protection substrate 41. Accordingly, the protection space 42 is open to the atmosphere and thus it is possible that the flexible film 21 may be subject to flexible deformation, by immediately following pressure fluctuations within a reservoir 23.

Then, a capping member 11 of the present embodiment is configured to be sealable such that the flexible film 21 including the entire protection substrate 41 is confronted in a sealing hollow section 13 from both sides at the opposite side to the flexible film 21 of the protection substrate 41. Accordingly, if the capping member 11 seals a nozzle formation surface 39, the entire protection substrate 41 is accommodated within the sealing hollow section 13, and the flexible film 21 accommodated within the protection space 42 of the protection substrate 41 is also sealed. Furthermore, if the capping member 11, which does not necessarily include the entire protection substrate 41 within the sealing hollow section 13, is sealable such that the inside of the protection space 42 of the protection substrate 41 is isolated from the atmosphere, only a portion of the protection substrate 41 may be included within the sealing hollow section 13. For example, in a state where a vent 43 of the protection substrate 41 is confronted in the sealing hollow section 13, a sealing sidewall section 11*b* at the opposite side to a nozzle plate 20 of the capping member 11 may be brought into contact with the bottom section 41*b* of the protection substrate 41. Furthermore, other configurations are similar to the first embodiment and thus the description will be omitted.

The present embodiment has the above-described configuration. Therefore, for example, it is possible to prevent damage to the flexible film 21 due to touching of a recording paper 5 on the flexible film 21 or the like. In addition, it is possible to prevent moisture evaporation from the flexible film 21 using the protection substrate 41 and thereby it is possible to more reliably suppress thickening of a liquid in the reservoir 23.

Figure 5:
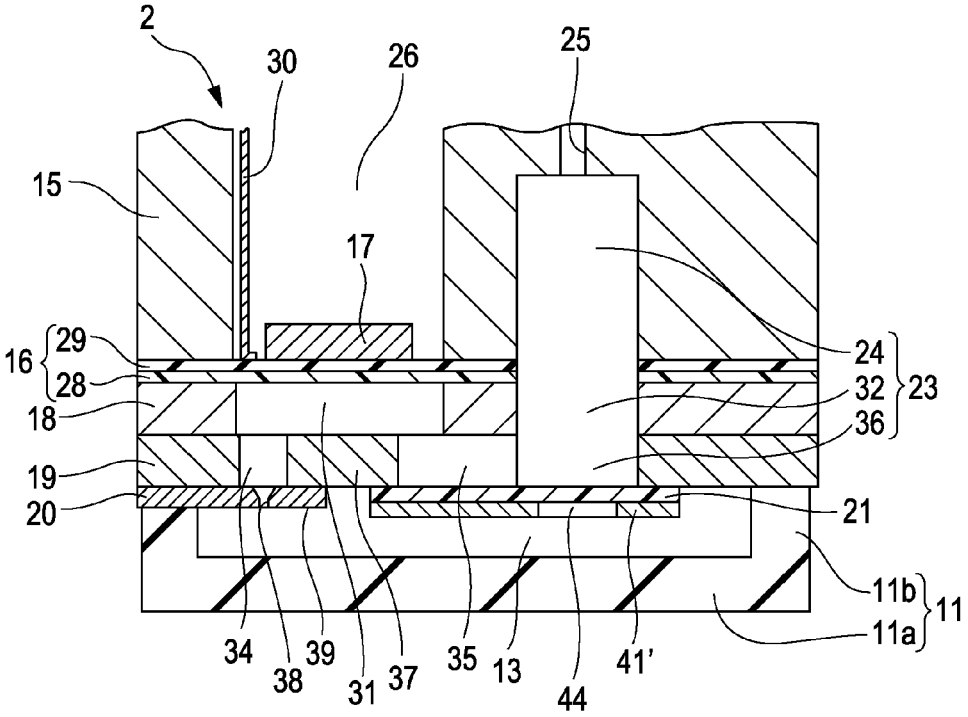
FIG. 5 is a cross-sectional view of a recording head in a sealed state using a capping member in a fourth embodiment.

Meanwhile, the protection substrate is not limited to that of the above-described third embodiment. As illustrated in FIG. 5, a protection substrate 41' of a fourth embodiment is layered at the lower side of a flexible film 21. An opening 44 is provided at a section corresponding to a reservoir 23 of the protection substrate 41'. In this manner, since the flexible film 21 of a section confronted in the opening 44 becomes capable of flexible deformation, the section comes to function as a compliance section of the reservoir 23. In addition, similarly to the above-described third embodiment, a capping member 11 is configured to be sealable such that the flexible film 21 including the entire protection substrate 41' is confronted in a sealing hollow section 13 from both sides at the opposite side to the flexible film 21 of the protection substrate 41'. Furthermore, in the capping member 11 of the present embodiment, it may be preferable to seal the opening 44 of the protection substrate 41' as well. The entire protection substrate 41' may not necessarily be included within the sealing hollow section 13. In addition, other configurations are similar to the above-described third embodiment and thus the description will be omitted.

In the present embodiment as well, similarly to the third embodiment, for example, it is possible to prevent damage to the flexible film 21 due to touching of a recording paper 5 on the flexible film 21 or the like. In addition, it is possible to prevent moisture evaporation from the flexible film 21 using the protection substrate 41' and thereby it is possible to more reliably suppress thickening of a liquid in the reservoir 23.

Figure 6:
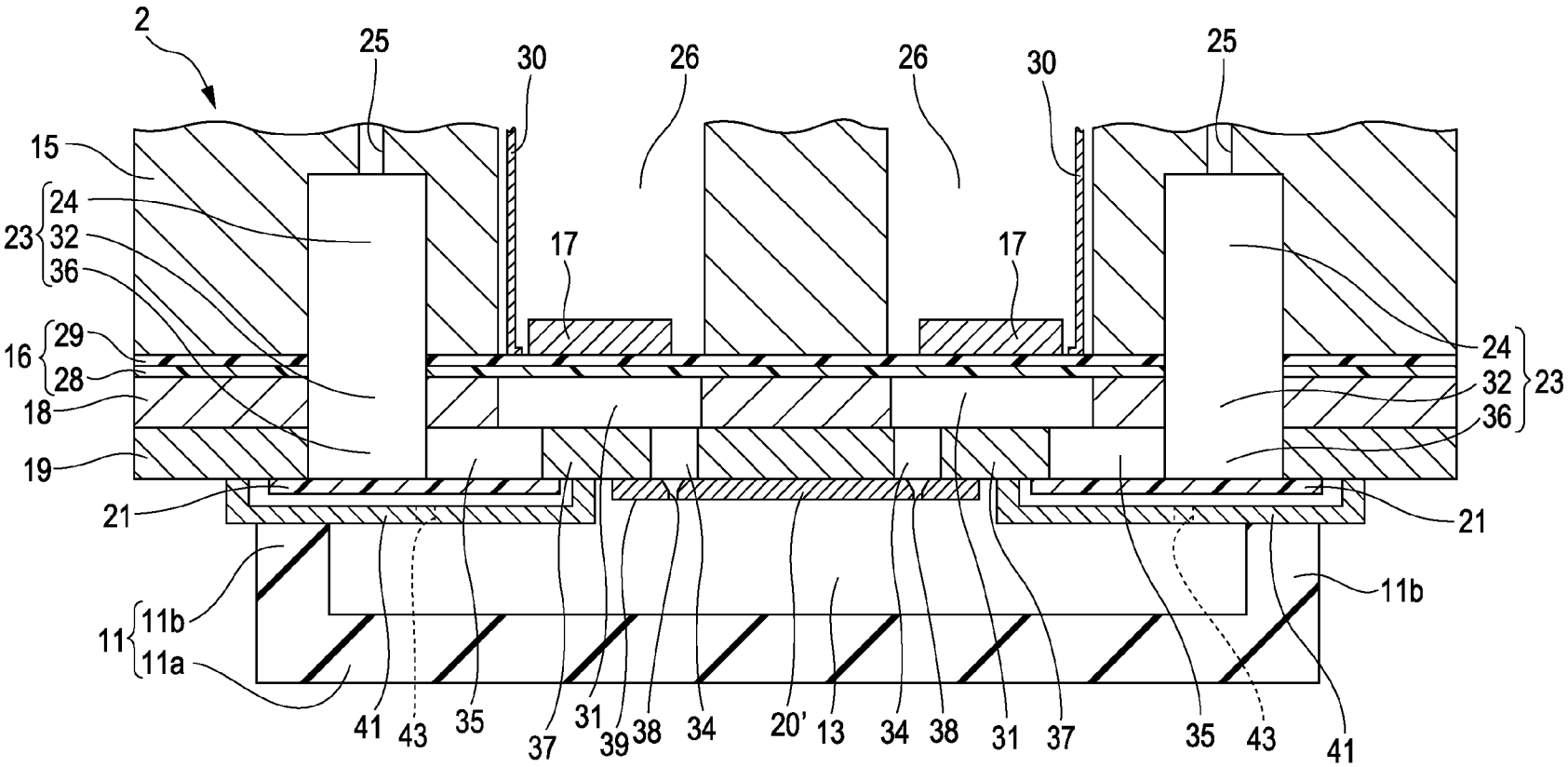
FIG. 6 is a cross-sectional view of a recording head in a sealed state using a capping member in a fifth embodiment.

In addition, in each of the above-described embodiments, only one reservoir 23 is provided corresponding to one nozzle line, but a plurality of reservoirs 23 may be provided corresponding to a plurality of nozzle lines. For example, a recording head 2 of a fifth embodiment illustrated in FIG. 6 includes two reservoirs 23 corresponding to two nozzle lines. In the present embodiment, two nozzle lines are set up at one nozzle plate 20' and a flexible film 21 configuring the bottom surface of the reservoir 23 and a protection substrate 41 protecting the flexible film 21 are respectively provided at both sides pinching the nozzle plate 20'. Furthermore, the recording head 2 of the present embodiment is configured to be symmetrical by pinching a center line between the nozzle lines. One side (right side in FIG. 6) thereof is configured similarly to the recording head 2 of the third embodiment and thus the description will be omitted.

A capping member 11 is configured to be sealable such that the flexible film 21 including the entire protection substrate 41 is confronted in a sealing hollow section 13 from both sides at the opposite side to the flexible film 21 of the protection substrate 41. The capping member 11 of the present embodiment is configured such that a sealing sidewall section 11*b* of one side in the perpendicular direction to the nozzle line comes into contact with one protection substrate 41, and the sealing sidewall section 11*b* of the other side comes into contact with the other protection substrate 41, in a state where a vent 43 of each protection substrate 41 is confronted in the sealing hollow section 13. Accordingly, the entire nozzle formation surface 39 positioned between both sides of the protection substrate 41 can be accommodated within the sealing hollow section 13, and in addition, the flexible film 21 accommodated within a protection space 42 of the protection substrate 41 can also be sealed.

Furthermore, in each of the above-described embodiments, as a pressure generator, a so-called bending vibration type of piezoelectric device 17 is exemplified, but without being limited thereto, for example, a so-called longitudinal vibration type of piezoelectric device can also be adopted. In addition, the present invention can also be applied to a configuration adopting a pressure generator such as a heating element which causes to generate pressure fluctuations by bumping an ink using generated heat or an electrostatic actuator which causes the generation of pressure fluctuations by displacing the diaphragm of a pressure chamber using electrostatic force.

Then, hereinabove, the printer 1 which includes the ink jet type recording head 2, a kind of liquid ejecting apparatus, is described as an example. However, the present invention can also be applied to a liquid ejecting apparatus which includes other liquid ejecting heads. For example, the present invention can also be applied to a liquid ejecting apparatus which includes a color material ejecting head used in manufacturing a color filter such as a liquid crystal display, an electrode material ejecting head used in forming an electrode such as an organic EL (Electro Luminescence) display or FED (Face Emitting Display), and a bio-organic material ejecting head used in manufacturing a biochip (biochemical device).

What is claimed is:

1. A liquid ejecting apparatus, comprising:

a head comprising:

a substrate defining a plurality of pressure chambers and a common liquid chamber;

a nozzle plate, comprising silicon, defining a plurality of nozzles; wherein the nozzle plate is adhered to a part of a surface of the substrate;

a flexible film sealing an opening in the substrate communicating with the common liquid chamber; and a protection substrate being adhered to another part of the surface of the substrate to which the nozzle plate is adhered at a distance from the nozzle plate and on opposite sides of the flexible film to cover the flexible film; and a capping member sealing the nozzles, wherein the capping member has a sealing hollow section and contacts to the protection substrate such that the entire nozzle plate is accommodated within the sealing hollow section.

2. The liquid ejecting apparatus according to claim 1, wherein in a lengthwise direction of the pressure chambers, a size of the nozzle plate is less than a size of the substrate.

3. The liquid ejecting apparatus according to claim 1, wherein the flexible film functions as a compliance section, wherein the common liquid chamber has an opening in the surface of the substrate, and wherein the flexible film seals the opening and is covered with the protection substrate.

* * * * *